US007407199B2

(12) United States Patent
Richardson

(10) Patent No.: US 7,407,199 B2
(45) Date of Patent: Aug. 5, 2008

(54) SELF-LATCHING DEVICE

(75) Inventor: Leigh Richardson, Upper Hutt (NZ)

(73) Assignee: Assa Abloy Financial Services AB, Stockholm (SE)

( * ) Notice: Subject to any disclaimer, the term of this patent is extended or adjusted under 35 U.S.C. 154(b) by 117 days.

(21) Appl. No.: 10/532,552

(22) PCT Filed: Oct. 24, 2003

(86) PCT No.: PCT/NZ03/00241

§ 371 (c)(1),
(2), (4) Date: Apr. 22, 2005

(87) PCT Pub. No.: WO2004/038141

PCT Pub. Date: May 6, 2004

(65) Prior Publication Data

US 2006/0033345 A1 Feb. 16, 2006

(30) Foreign Application Priority Data

Oct. 24, 2002 (NZ) ..... 522198
Jan. 23, 2003 (NZ) ..... 523775

(51) Int. Cl.
*E05C 1/08* (2006.01)
*E05C 1/12* (2006.01)

(52) U.S. Cl. ..... 292/163; 292/169; 292/175; 292/DIG. 20

(58) Field of Classification Search ..... 292/DIG. 20, 292/DIG. 47, 137, 159, 169, 140, 150, 163, 292/175, 169.13
See application file for complete search history.

(56) References Cited

U.S. PATENT DOCUMENTS

| | | | | |
|---|---|---|---|---|
| 160,525 | A * | 3/1875 | Husted | 292/332 |
| 1,302,873 | A | 5/1919 | Stiff | |
| 2,127,061 | A * | 8/1938 | Hearn | 292/5 |
| 5,437,173 | A * | 8/1995 | Spinar | 70/89 |
| 5,611,581 | A * | 3/1997 | Ghostley | 292/165 |
| 5,794,991 | A * | 8/1998 | Smallegan et al. | 292/169 |
| 5,918,916 | A * | 7/1999 | Kajuch | 292/163 |
| 5,927,769 | A * | 7/1999 | Pullen | 292/169.13 |
| 6,485,070 | B1 * | 11/2002 | Schultz | 292/175 |
| 6,669,242 | B2 * | 12/2003 | Fountaine et al. | 292/11 |
| 6,827,376 | B2 * | 12/2004 | Fountaine | 292/98 |
| 6,846,025 | B2 * | 1/2005 | Sclater et al. | 292/336.3 |
| 2006/0033343 | A1 * | 2/2006 | Xu | 292/139 |
| 2006/0038413 | A1 * | 2/2006 | Rebel et al. | 292/165 |

FOREIGN PATENT DOCUMENTS

| | | |
|---|---|---|
| EP | 0 136 891 | 11/1990 |
| GB | 2286627 | 8/1995 |
| JP | 9028007 | 1/1997 |

* cited by examiner

*Primary Examiner*—Patricia Engle
*Assistant Examiner*—Alyson M Merlino
(74) *Attorney, Agent, or Firm*—Blakely, Sokoloff, Taylor & Zafman LLP

(57) ABSTRACT

A self-latching sash latch device for use with a sliding closure. The latch device has a primary bolt (15) which in use engages with a strike (12). The primary bolt (15) is coupled to an operating element (13) whereby the primary bolt is moveable from a latching position to a retracted position. A retainer (38) retains the primary bolt (15) in the retracted position. A secondary bolt (16) is moveable with or independent of the primary bolt (15) and is engageable with the retainer (38) to release the retainer and enable the primary bolt (15) to move from a retracted position to the latching position.

17 Claims, 8 Drawing Sheets

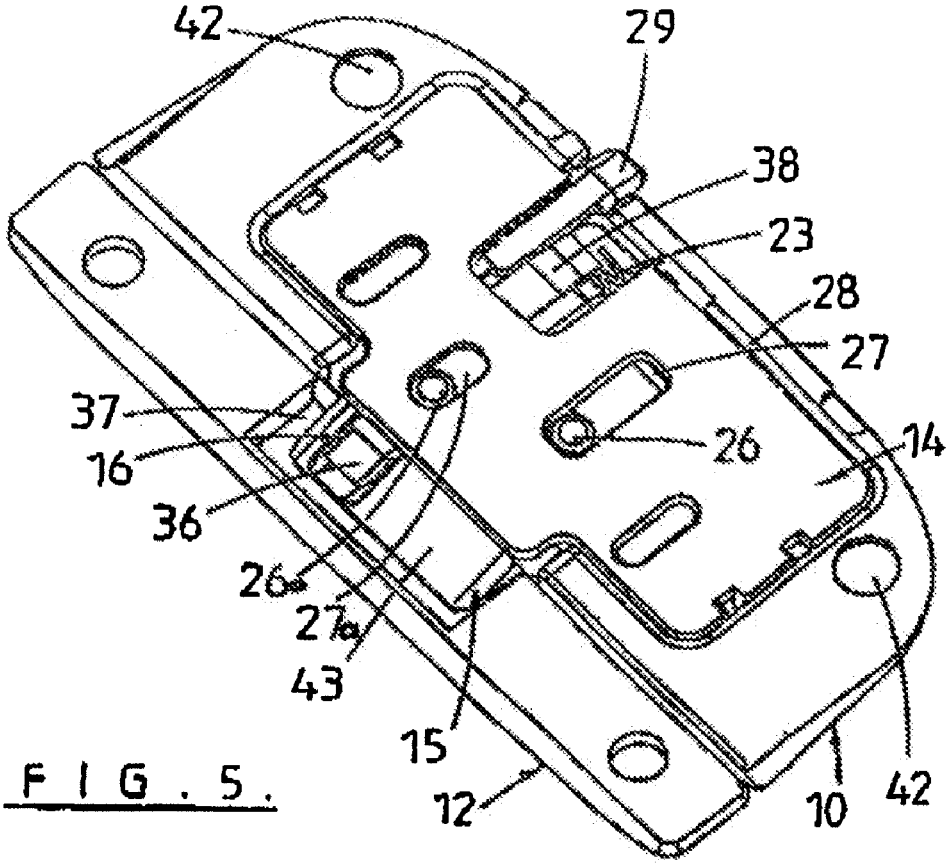
FIG. 5.
FIG. 4.
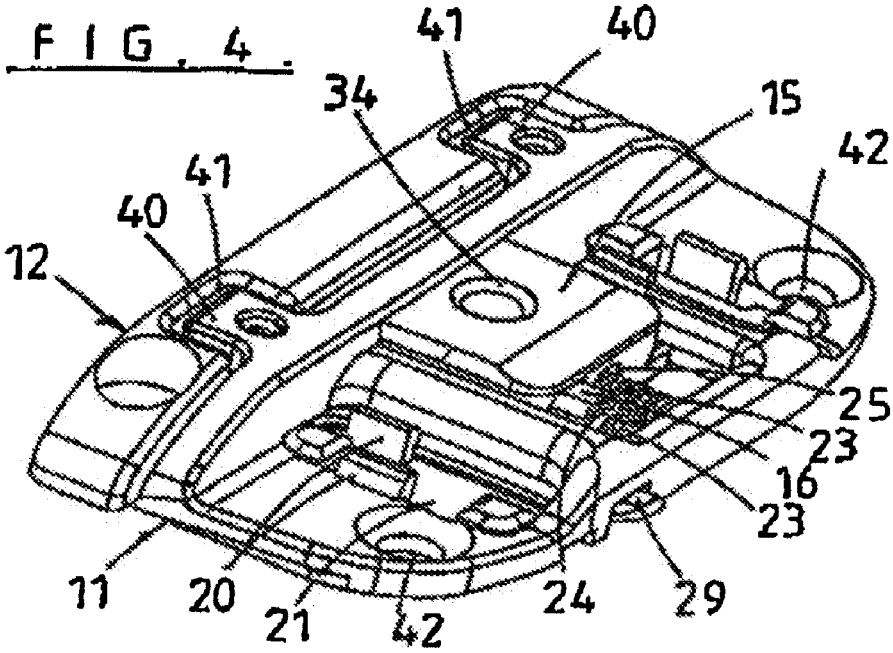

SELF-LATCHING DEVICE

The present patent application is a non-provisional of International Application No. PCT/NZ03/00241, filed Oct. 24, 2004.

BACKGROUND TO THE INVENTION

This invention relates to a latch device and more particularly one which is self-latching. The latch device is primarily intended for the latching of a sliding window sash in the closed position in a window frame.

Currently there are a number of self-latching window sash latches available on the market. In most cases the latch operates after the window has been physically closed. Thus when the latch has reached the same level as the strike it latches the window in the closed position. To open the window an operating member e.g. a pull lever is operated and is held in the "open" position until such time as the latch has been lifted or slid past the strike. The operating member is then released.

One problem with this type of latch device arises when disengaging the latch from the strike. As described above the action of opening the window involves holding the operating member and at the same time physically lifting or moving the window. Not only is this action awkward to perform but also it can be very difficult to perform on large windows, windows without finger grips, windows with more than one latch and windows which have limited/restricted access.

A second problem is related to security and safety. With known latches there is no indication once the window sash has been moved to its fully closed position as to whether the latch has in fact successfully engaged with the strike. Thus a window thought to be latched may, in fact, be unlatched which can give rise to potential safety and security risks.

SUMMARY OF THE INVENTION

An object of the present invention is thus to provide a sash latch device that self-latches when the window sash is moved to the closed position.

A further object of the present invention is to provide a sash latch device which self-latches and provides an indication if the latch has not completely self-latched.

It is yet a further object of the present invention to provide a sash latch device, which permits the latch to be activated such that after activation the user can use both hands to pull or slide the window sash into an open position.

Broadly according to one aspect of the invention there is provided a sash latch device of a self-latching type including a primary bolt for, in use, engagement with a strike, the primary bolt being coupled to an operating element whereby the primary bolt is moveable from a latching position to a retracted position, retaining means to retain the primary bolt in the retracted position and an activation means operable to release the retaining means to enable the primary bolt to move from the retracted position to the latching position.

Broadly according to a second aspect of the invention there is provided a self-latching sash latch device including a latch body having a primary bolt, a strike, the primary bolt being mounted for movement in said body between a latching position where, in use, the primary bolt engages in a latching configuration with the strike and a retracted position, and an operating element operatively coupled to the primary bolt to enable the primary bolt to be moved from the latching position to the retracted position, a retaining means to retain the primary bolt in the retracted position and a release member moveable with or independent of the primary bolt to effect release of the retaining means to release the primary bolt and enable it to move from the retracted position to the latching position.

Preferably the latch includes an indicator element which projects from the latch to indicate that the primary bolt is not in its latching position.

BRIEF DESCRIPTION OF THE DRAWINGS

In the following more detailed description of the present invention in its preferred forms, reference will be made to the accompanying drawings in which:

FIG. 4 is a top perspective view of the first embodiment of the latch device with the cover removed and the latch device in the closed position with a strike, FIG. 5 is an underside view of the arrangement shown in FIG. 4.

DESCRIPTION OF PREFERRED EMBODIMENTS OF THE INVENTION

Figure 1:
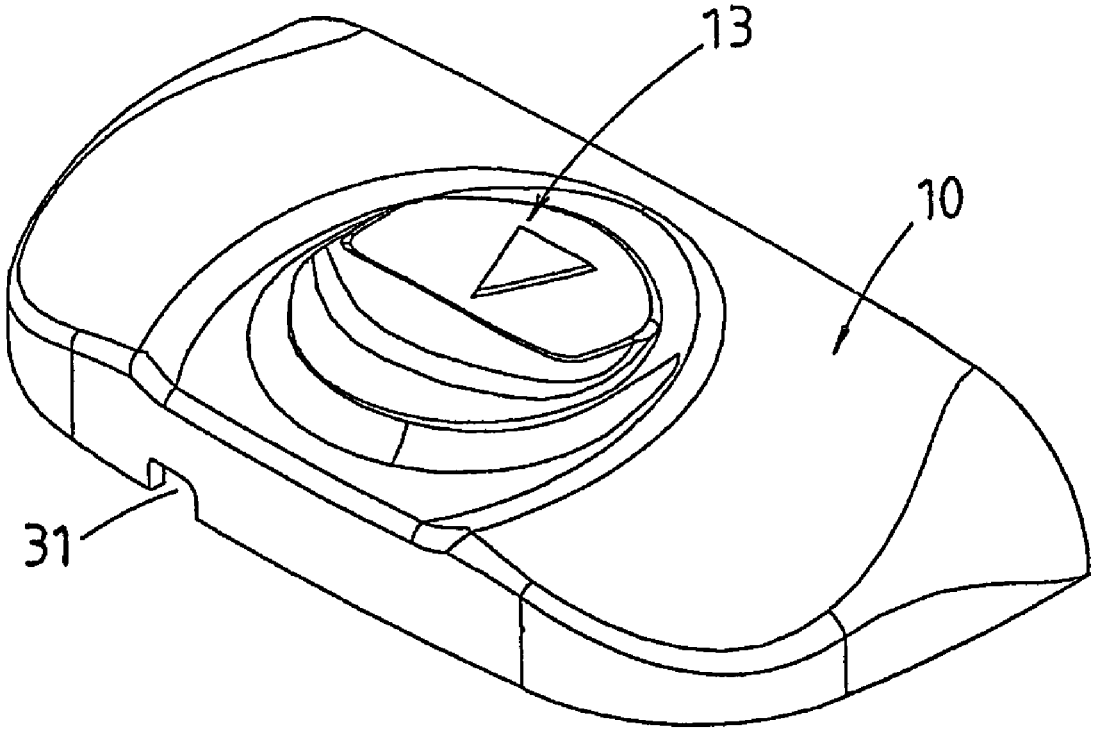
FIG. 1 is a perspective view of the latch device according to a first embodiment of the invention.
Figure 2:
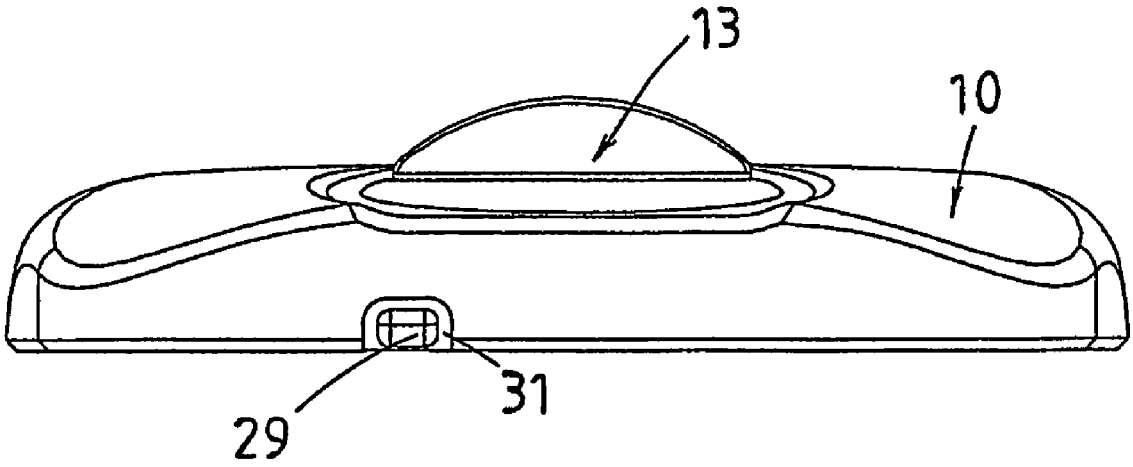
FIG. 2 is a front elevation view of the latch device shown in FIG. 1.

The sash latch device according to the present invention includes a cover 10 of suitable plastic or die cast zinc construction. The cover 10 is able to be mounted onto a chassis 11 in e.g. a slide dip fashion. The chassis 11 is preferable of die cast zinc construction.

A latch element, as hereinafter described, is engageable with a strike 12. A button 13 or operating member is provided with cover 10 for operation of the latch element. The latch device further includes a base 14, which in the preferred form is plastic.

According to the present invention the latch element comprises a primary bolt 15 and a secondary bolt 16. These components can be made from a suitable plastic or metal.

The primary bolt 15 is located in an opening 17 in the chassis 11 such that projecting edges 18 of the primary bolt 15 slidingly engage with shoulders 19 at each side of opening 17. The primary bolt 15 is held in place in the chassis 11 by a base 14. The base 14 preferably clip mounted onto the chassis 11 by two pairs of spring clips 20 which, as shown in e.g. FIG. 4, clip over opposed edges of an aperture 21 in the chassis 11.

The primary bolt 15 has a passageway 22 in which the secondary bolt 16 is slidingly engaged. A pair of springs 23 and 23*a* are provided for biasing the primary bolt 15 and the secondary bolt 16 to a "projecting" or latching position. One end of a spring 23 is located in a bore 24 in the secondary bolt 16. The other spring 23 is located in a recess 25 in the primary bolt 15.

Each of primary bolt 15 and secondary bolt 16 have a projecting lug 26 and 26*a* respectively, which slidingly engage in respective slots 27 and 27*a* in the floor of base 14. Thus with the secondary bolt 16 located in passageway 22 of the primary bolt 15 and the primary bolt 15 held in position in opening 17 in the chassis 11, by the clip fastening of base 14 to the chassis 11 the free ends of the springs 23 and 23*a* engage against a surface formed by wall 28 of the chassis 11. The primary and secondary bolts 15/16 are thus always biased to a projecting position (see for example FIG. 5) as will hereinafter become apparent.

Attached to or forming part of the primary bolt 15 is an indicator 29. This is an elongate member which is slidingly engaged through an opening 30 in wall 28. Opening 30 is aligned with an opening 31 in cover 10 when the cover 10 is clipped onto the chassis 11.

The button 13 has a downwardly projecting spigot 32 which engages through an elongate slot 33 in the top of the cover 10. Spigot 32 engages in an opening 34 in the primary bolt 15.

In use, the chassis 11 (after primary/secondary bolts 15/16 and base 14 have been clipped into place) is fastened to a section of a window sash S. This is achieved by mechanical fasteners such as screws, bolts etc. engaging through openings 42 in the chassis 11. Once the chassis 11 has been fastened into place the cover 10 is clipped over the chassis 11 which results in the button 13 engaging with the primary bolt 15.

Figure 6:
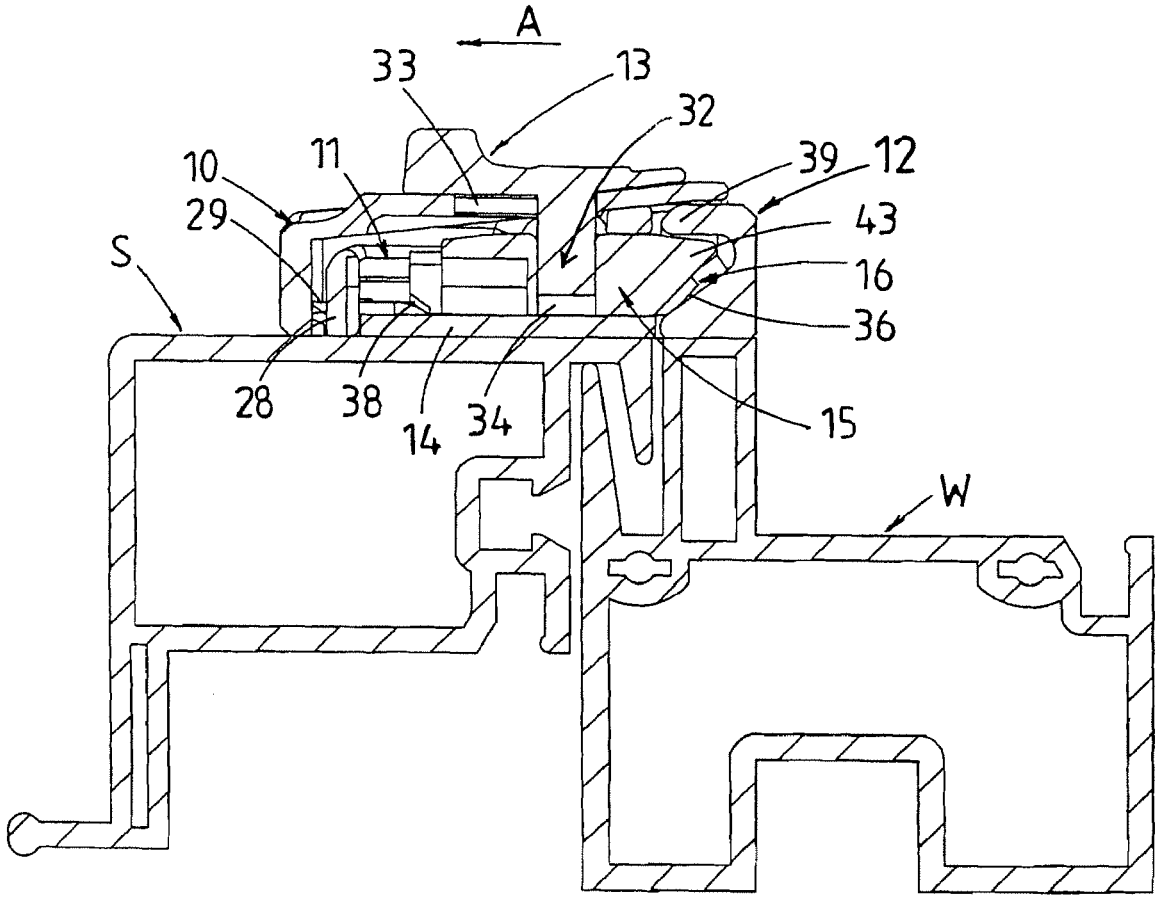
FIG. 6 is a cross sectional view of the latch device according to the first embodiment when mounted with a section of a window sash.

In a conventional manner, the strike 12 is mounted to another section which forms the opposing part of a sash or window frame as the case may be. In FIG. 6 the strike 12 is shown fastened to a part of a fixed window frame W though equally in a double sliding sash arrangement the strike 12 would be fitted to the second sash.

To further describe the invention the latch and its associated strike 12 are considered to be mounted to the sash S and frame W with the primary bolt 15 projecting into the strike 12 (see for example FIG. 6). Because of the presence of the wall 39 or overhang of the strike 12 sash S is not able to move relative to frame W.

If a sliding action is applied to the push button 13 so that it moves in the direction of arrow A (see FIG. 6) the primary bolt 15 will be moved so that the beak portion 43 of primary bolt 15 clears the wall 39. This means that the beak 43 of the primary bolt 15 moves out of the cavity 37 in the strike 12 (see FIG. 13). When the primary bolt 15 is moved in the direction of arrow A it comes into engagement with the trigger spring clip 38 in the base 14. As a result the primary bolt is held in the retracted position. This therefore enables the user to use both hands to cause the sash S to be moved relative to the frame W.

The secondary bolt 16 has a double inclined leading edge formed by oppositely inclined surfaces 35 and 36. When primary bolt 15 is retracted the secondary bolt still protrudes into cavity 37. However, as the sash S is opened surface 35 of the secondary bolt 16 contacts the edge of wall 39. This causes the secondary bolt 16 to be pushed back into the primary bolt 15 for a distance sufficient to enable the secondary bolt 16 to clear the strike 12.

This movement of the secondary bolt 16 also results in the secondary bolt 16 engaging a trigger clip 38 to thereby release the primary bolt 15. Consequently, the primary bolt 15 moves back to its projecting position in preparation for self-latching with the strike when the window is closed.

Figure 3:
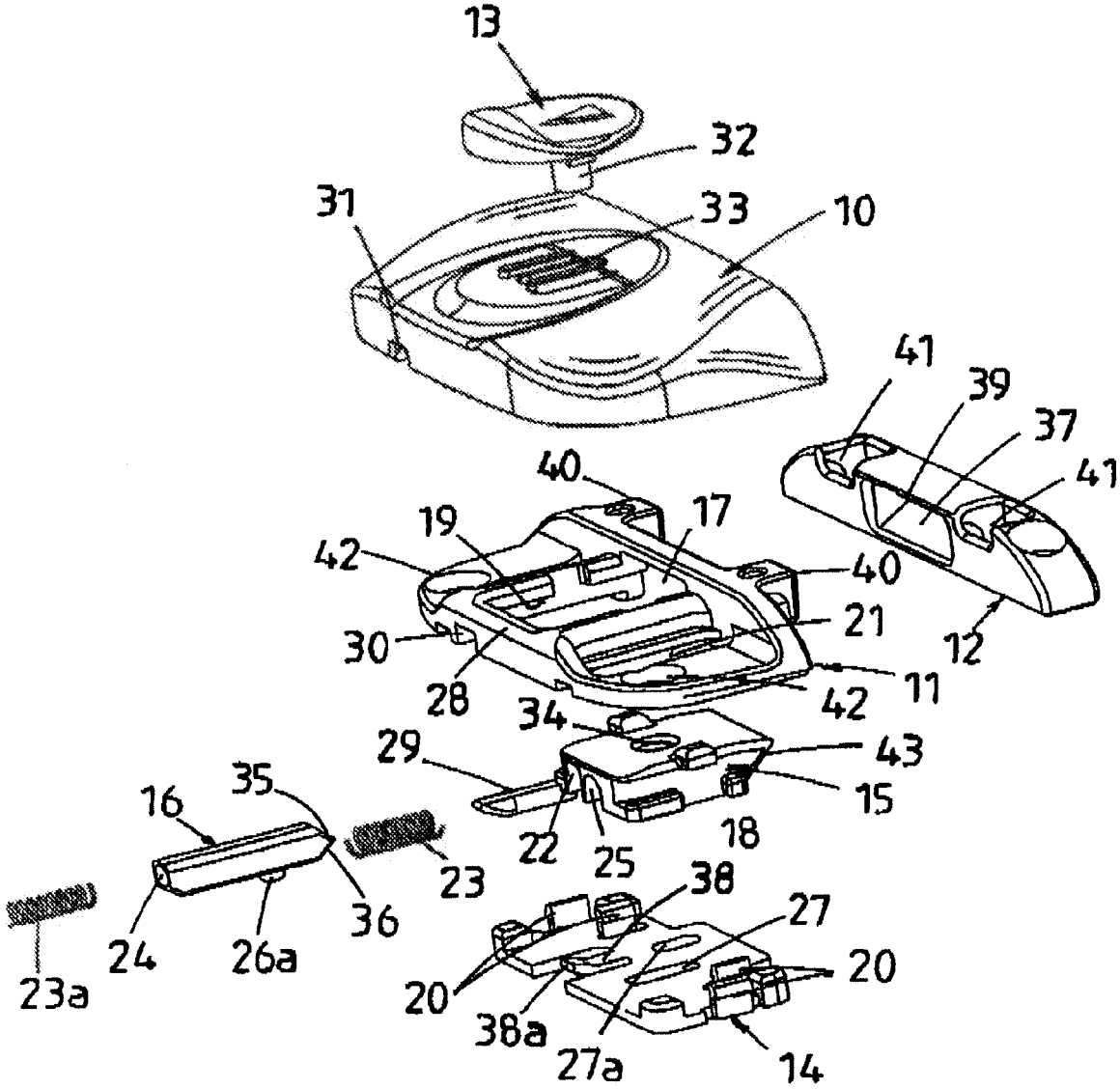
FIG. 3 is an exploded perspective view of the latch device in FIGS. 1 and 2.

As shown in FIG. 3 trigger clip 38 is formed as an integral part of base 14 and extends on an upward incline to a distal or terminal end 38*a*. The elongate slot 27*a* in base 14 (which the spigot 26*a* of the secondary bolt 16 slidingly engages) is, as shown in FIG. 3, offset from the longitudinal centre line of the trigger 38. Consequently when the secondary bolt 16 slides into the retracted position it slides over only pad of the width of the trigger 38. The chamfered end 16*a* of the secondary bolt 16 thus rides over the inclined distal end 38*a* and forces the trigger clip to depress.

Figure 7:
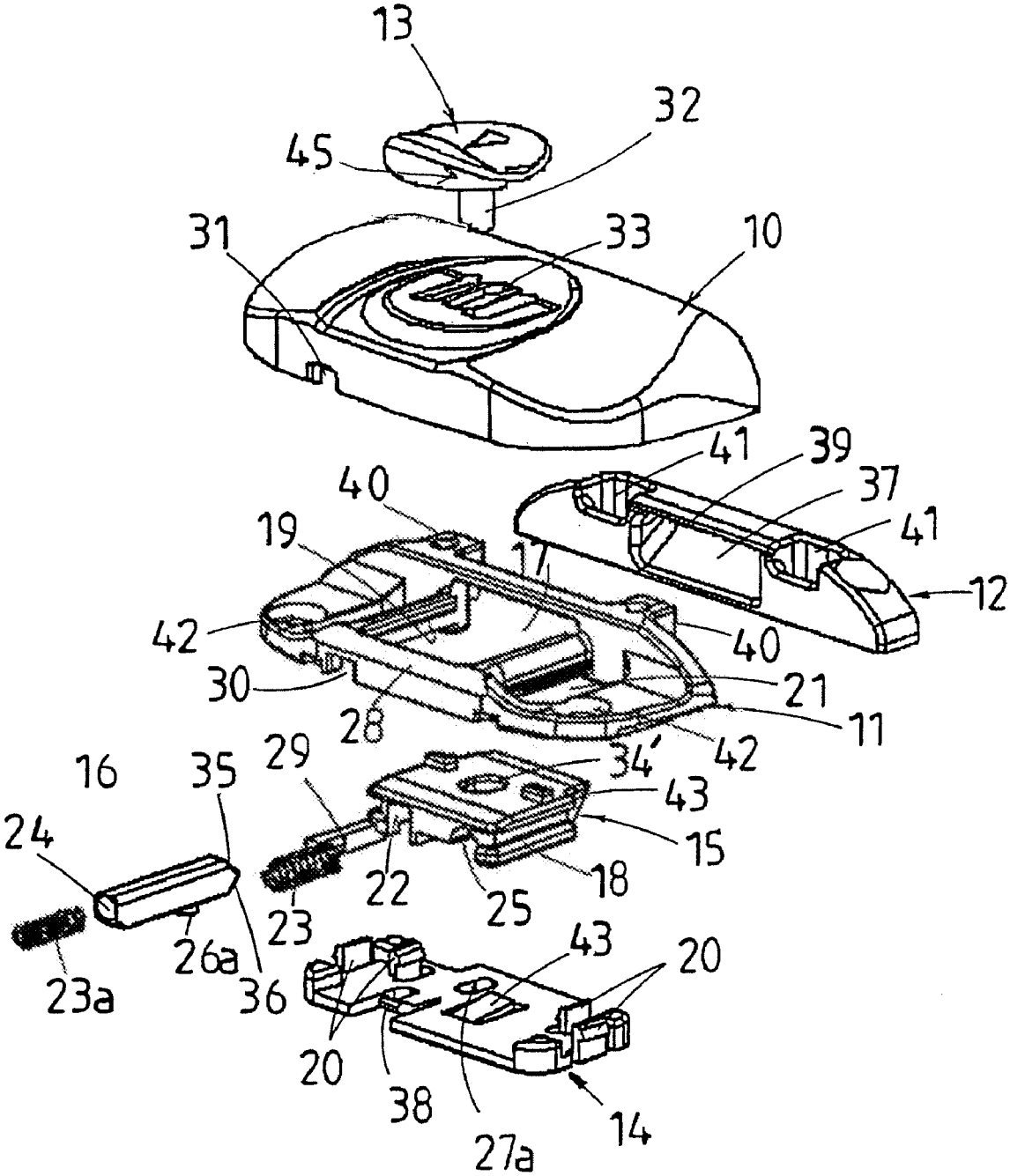
FIG. 7 is an exploded view of a second embodiment of the latch device.

This action of depressing the trigger clip 38 removes the engagement between the distal end 38*a* and primary bolt 15 to thereby release the primary bolt 15 to move to its extended position under the action of spring 23. The skilled person will realise that for trigger 38*a* to engage the primary bolt a largely conventional arrangement is employed where the primary bolt will, when moved into the retracted state, slide over the inclined distal end 38*a* thereby depressing the trigger 38. The trigger 38 will, however, spring back to its projecting position (as shown in FIGS. 3 and 7) to engage behind that part of the primary bolt that has slid over the trigger 38 to depress same.

Figure 13:
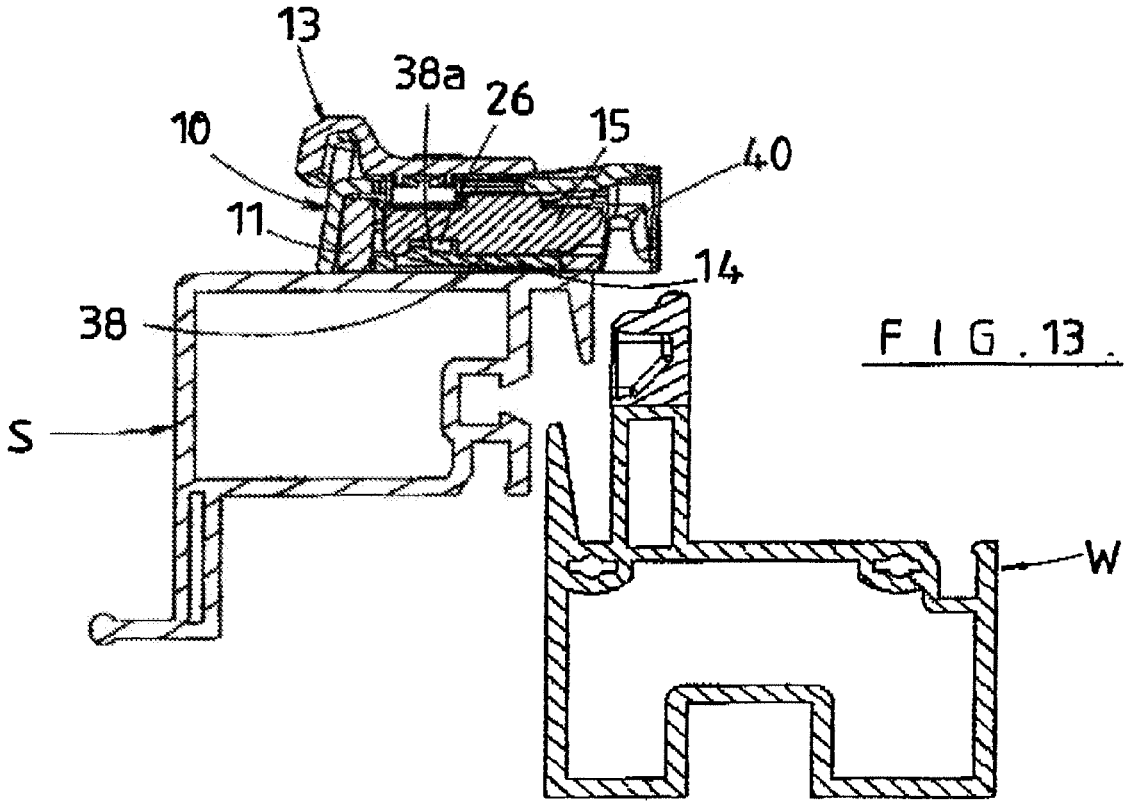
FIG. 13 is a cross-sectional view through the latch device and particularly the primary bolt such as to show the primary bolt in its retained retracted position.

The primary bolt when held in the retracted position is shown in FIG. 13. This drawing also shows that the sash S has moved to a partially open position relative to the frame W.

When the window is moved back to the closed position the leading surface 36 of secondary bolt 16 comes into engagement with wall 39. This causes the secondary bolt 16 to be moved (in the direction of arrow A) relative to primary bolt 15. In the event that the primary bolt 15 has been held in the retracted position (by someone holding the primary bolt 15 when opening the window) this movement of secondary bolt 16 results in secondary bolt engaging with the trigger clip 38. This activates the clip to cause release of the primary bolt 15.

The beak 43 can thus contact the edge of wall 39 such that when the sash is moved to the fully closed position the beak may enter the cavity 37. The latching device therefore self-latches when the latch reaches the same level as the strike.

Consequently during both opening and closing of the window the secondary bolt 16 can cause release of the primary bolt. This ensures that the primary bolt 15 will always self latch.

As shown in the drawings the chassis 11 also has a pair of protrusions 40 which are parallel and spaced apart. These correspond in position with two cavities 41 one of which is located either side of the main cavity 37 of strike 12. As the window S is closed these protrusion 40 (whose geometry is such as to accommodate window tolerance variance) come into contact with the corresponding cavities 41 in the strike 12. They thereby align the latch to the strike in the horizontal, vertical and lateral planes.

Figure 8:
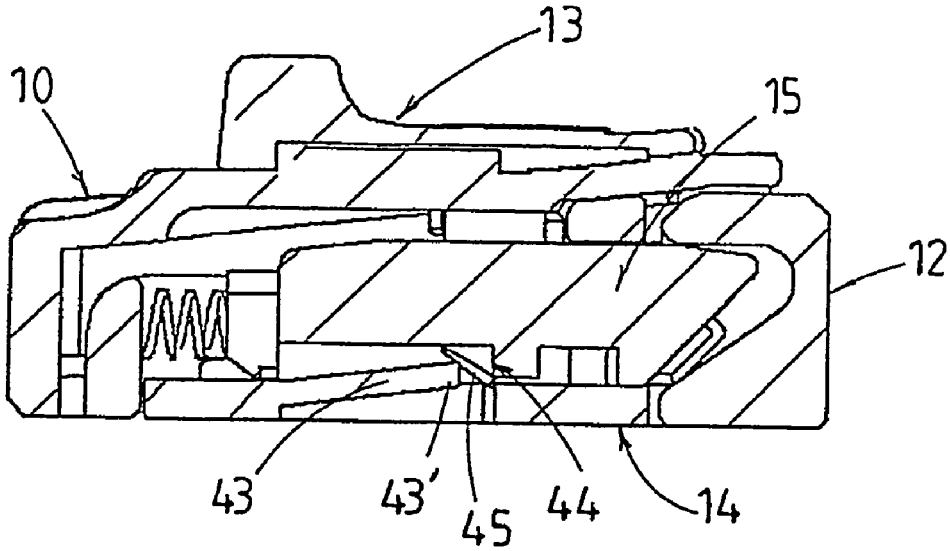
FIG. 8 is a sectional view of the second embodiment.
Figure 9:
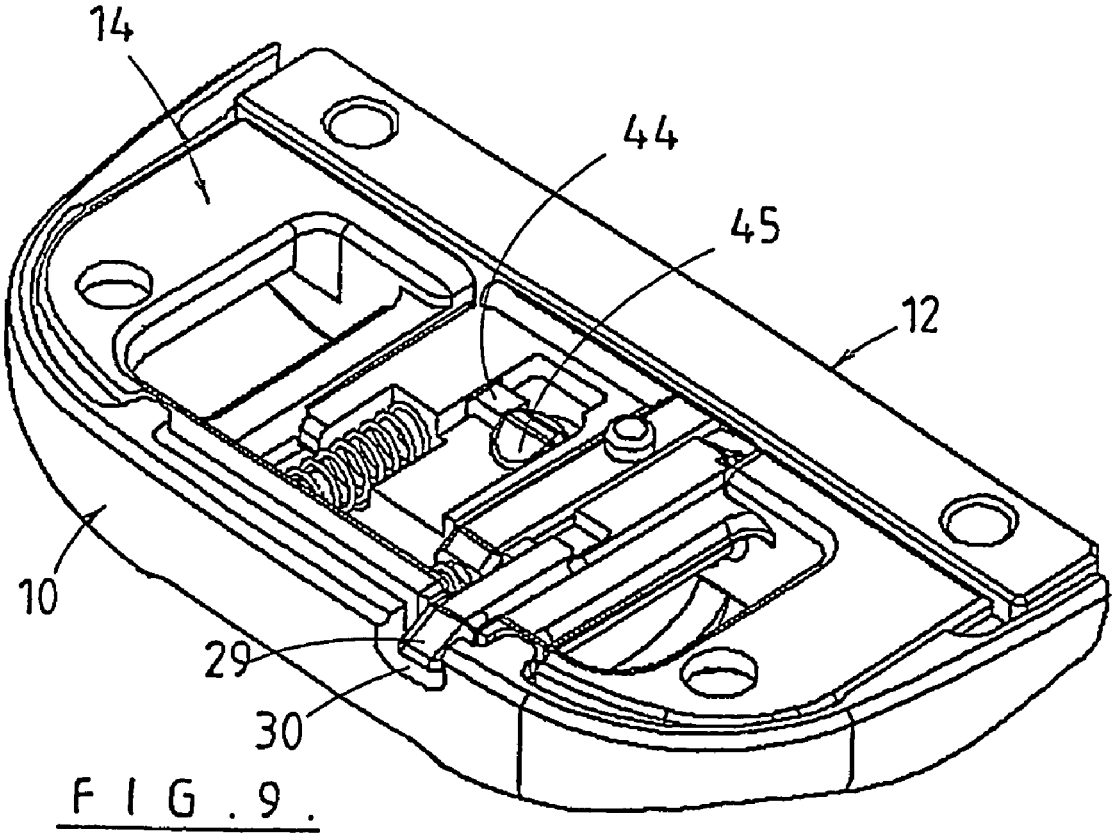
FIG. 9 is an underside view of the second embodiment but with the base removed.

Referring now to FIGS. 7, 8 and 9 a second embodiment of the latch device is illustrated. This embodiment of the invention incorporates an anti-tamper feature which prevents the primary bolt 15 from being forcibly retracted through manipulation from outside of the dwelling (i.e. the bolt being pushed back from striking engagement by use of a blade etc.). According to this embodiment of the invention the button 13 must be used in order for the latch to be moved to an unlocked position.

The anti-tamper feature includes an anti-tamper clip 43 which is situated in the base 14. As the base 14 is in the preferred form of plastic construction the anti-tamper clip 43 can be integrally formed with the base 14. The anti-tamper clip 43 has the function of preventing the primary bolt 15 from retracting. This is achieved by the distal end 43 of the clip 43 engaging against edge 44 of the primary bolt 15.

In this form of the invention the button 13 which is clipped into cover 10 and is slidingly moveable has a profiled or sloping end 45 on the spigot 32. The spigot 32 engages in an opening in the primary bolt 15 as previously described but in this embodiment the opening 34' is. Consequently a lost motion in bolt 15 is achieved. Thus if the primary bolt 15 is tampered with the bolt will slide back and engage with the anti-tamper clip 43 but the button 13 will not move because of the lost motion.

The anti-tamper clip 43 is moved out of the way of the primary bolt 15 by the profiled end 45 of the button 13 sliding over the clip 43 hence pushing the clip clear of the primary bolt. The button 13 then continues to retract the primary bolt 15 in the normal manner.

In the form of the invention as illustrated the primary bolt 15, if forced back by external manipulation, moves approximately 1.5 mm before it is stopped by the anti-tamper clip 43. As indicated above the button 13 does not move during this movement of the primary bolt 15. As a result there is no "redundant" travel of the button 13 during normal operation. Therefore, the anti-tamper feature is not readily discernable to the user as it is a feature which only comes into effect if attempts are made to forcibly open the latch from the outside.

It is believed that the present invention addresses the problems previously identified and associated with known self-latching window sash latches. It achieves these objectives as follows:

The action to disengage the latch from the strike is a "once-off" finger motion which results in the sliding movement of the button 13. Once this motion is completed the primary bolt 15 is held in the retracted position which, therefore, allows the user to remove his or her hands from the latch without the primary bolt 15 re-engaging in the strike 12. The user therefore has both hands free to open the window sash.

The latch provides clear visual indication of whether the strike has been successfully engaged. Thus if the indicator 29 is protruding from opening 31 in cover 10 this is an indication that the primary bolt 15 has not moved back to its fully projecting position i.e. Hag not fully latched. The indication is visible from a distance and allows a user to quickly assess if the window is secure.

The latch according to the present invention provides the above identified features without introducing additional steps to its operation. It retains all the benefits of a self-latching latch while providing features not normally available with self-latching latch devices.

The combination of self-latching, indication and hands free operation is achieved by having the secondary bolt, the trigger spring clip 38 and primary bolt 15 all dependant on each other for timing, position and overall function. This, however, is achieved in a straight forward and operationally effectively manner.

As disclosed herein the present invention can incorporate an indicator, which indicates whether the latch is in the locked or unlocked position. Currently there are a number of window hardware products available on the market and some of these have a method of indicating if the window is latched or not. These however suffer from deficiencies which include one or more of the following, namely, the need for additional parts (which leads to additional cost both in parts and assembly), not clear contrast between open and closed, difficulty in ascertaining if a latch is partially open or closed and the indicator being visible from outside the window (which can result in a security risk).

Figure 12:
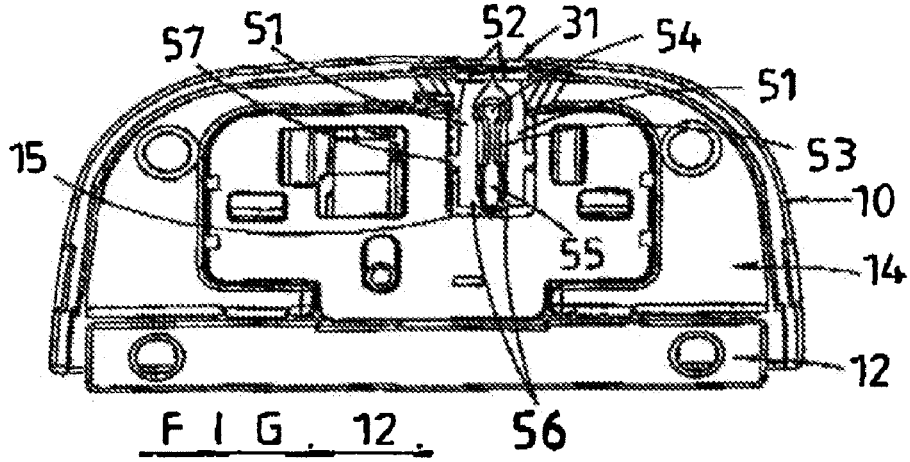
FIG. 12 is a view similar to views 10 and 11 but showing a fourth embodiment with the latch in the "locked" position.
Figure 10:
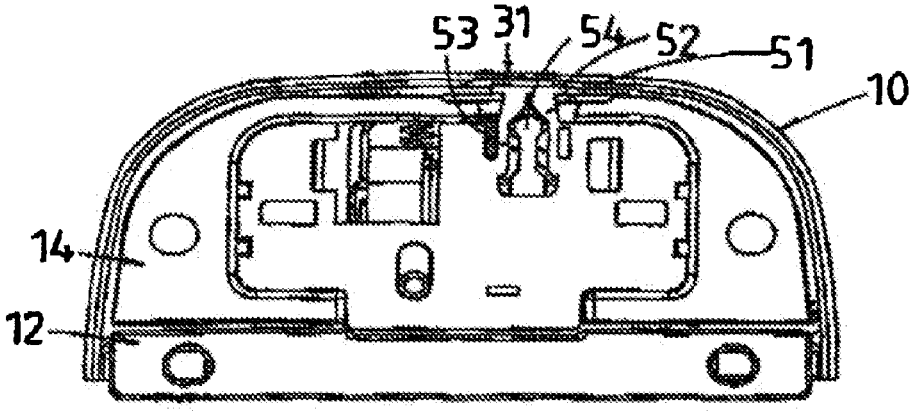
FIG. 10 is an underside view of a third embodiment of the latch device according to the invention, the latch being in the "locked" position.
Figure 11:
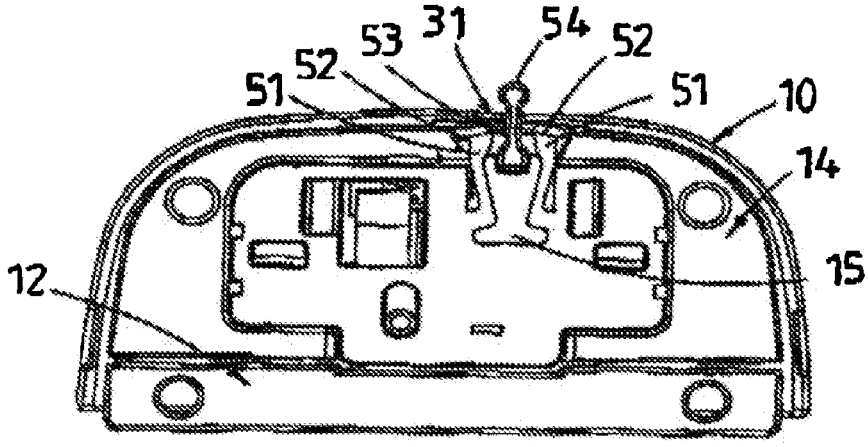
FIG. 11 is a view similar to FIG. 10 but showing the latch in the "unlocked" position.

In a further version of the present invention as shown in FIGS. 10-12, the invention provides an indicator which does not require additional components, is clear and obviously open or shut and cannot be seen from outside the window. The indicator therefore deals with the deficiencies associated with currently known indicators.

As shown in FIG. 10, the base 14 has moulded into it, two legs 51 which are located spaced apart and side by side. The shape and thickness of these legs 51 is designed so that the legs act like hinged springs. The distal ends of the legs 51 have integrally moulded therewith flaps 52. As can be seen in FIG. 10, these flaps 52 obstruct the opening 31 in the cover 10.

As previously disclosed, the primary bolt 15 has a protrusion 53 extending from the back of it. In one form of the invention the protrusion 53 is moulded as part of the primary bolt 15.

When the primary bolt 15 is disengaged from the strike 12, the protrusion 53 pushes its way through the flaps 52 so that the distal end 54 of the protrusion 53 shows (with contrasting colour) through the window 31. The design of the legs 51 and the protrusion 53 ensure that the flaps 52 open very quickly, because the flaps are either side of the protrusion 53 and the hinge in a plane perpendicular to the direction of movement of the protrusion. As a consequence, there is nearly instant colour contrast between the distal end 54 of the protrusion 53 and the surrounding material of the cover 10.

The indicator does not require additional components as the features are incorporated as part of existing components of the self-latching lock. Because the protrusion is designed to minimise time from open to closed and vice versa, it is easy to identify whether the lock is latched or not. Because the indicator is positioned at the front side (facing internally of the latch) it makes it very difficult to see from outside the window, thus, the indicator is not readily visible, which if it were, could result in a security risk.

FIG. 12 shows a different version of the arrangement shown in FIGS. 10 and 11. According to this version, the legs 51 are no longer attached at one end and free at the other. Legs 51 are, as can be seen from FIG. 12, attached to the base 14 about two-thirds of the way down the length of the leg.

A further difference is that the protrusion 53 still retains a knob 54 at its extreme or distal end. However, it additionally has a wider extended knob 55 at the base of the protrusion.

According to this arrangement, the legs have a pivotal hinging point rather than a just one hinge. This allows the knob 54 at the distal end of the protrusion 53, to open the flaps 52 and the legs 51 in the "bolt retraction stroke". However, on the "bolt engagement stroke" the knob 55 contacts the legs 51 in the area 56 below the pivot point 57, thereby closing the legs 51 and hence flaps 52.

The advantage of using this arrangement is that the indicator is not reliant on the memory or spring of the plastic to close the flaps (the hinge may deteriorate over time and return the flaps to the closed position, leaving them partially opening and thereby reducing the effectiveness of the indicator). The protrusion 54 opens and closes the flaps 52 mechanically every time, thereby ensuring the flaps are positively opened or closed.

The invention claimed is:

1. A self-latching sash latch device including a latch body having a primary bolt, a strike, the primary bolt being mounted for sliding movement in said body between a latching position where, in use, the primary bolt engages in a latching configuration with the strike and a retracted position, and an operating element operatively coupled to the primary bolt to enable the primary bolt to be moved from the latching position to the retracted position, a retaining means to retain the primary bolt in the retracted position and a secondary bolt movably engaged with the primary bolt to be moveable together with the primary bolt and relative to the primary bolt, the secondary bolt has a leading end which has a first engagement surface which is exposed for contact with a part of the strike when the primary bolt is moved to the retracted position by the operating element, whereby contact between the first engagement surface and said part of the strike during relative movement between the body and strike causes the secondary bolt to move relative to the primary bolt to the position where the secondary bolt effects release of the retaining means to release the primary bolt and enable the primary bolt to move from the retracted position to the latching position.

2. The latch device as claimed in claim 1, wherein the primary bolt is biased by biasing means to move to the latching position.

3. The latch device as claimed in claim 1, wherein the secondary bolt is slidingly located in the primary bolt.

4. The latch device as claimed in claim 1, wherein the primary bolt is slidingly mounted in a chassis which is removably coupled to a base.

5. The latch device as claimed in claim 4, further including a cover removably mounted to the chassis.

6. The latch device as claimed in claim 1, wherein the first engagement surface is a surface, which is inclined relative to the direction in which the secondary bolt is moveable.

7. The latch device as claimed in claim 1, wherein said strike has a wall which overlaps an engagement portion of the primary bolt when the primary bolt is in the latching position and the latch device is in a latching configuration.

8. The latch device as claimed in claim 1, wherein the secondary bolt has a second engagement surface which is engageable with said part of the strike upon relative movement between the body and strike occurring in an opposite direction.

9. The latch device as claimed in claim 1, wherein the primary bolt and the release means are independently biased by separate biasing means.

10. The latch device as claimed in claim 9, wherein the retaining means is a spring clip engageable with an abutment of the primary bolt.

11. The latch device as claimed in claim 10, wherein the release member is moveable to a position where it moves the spring clip out of engagement with the abutment to thereby release the retaining means.

12. The latch device as claimed in claim 4 or 11, further including limiting means engageable with the primary bolt when in the latching position.

13. The latch device as claimed in claim 11, further including limit release means engageable with the primary bolt when in the latching position operable by the operating element to release the limiting means to free the primary bolt for movement from the latching position to the retracted position.

14. A self-latching device including a latch body having a primary bolt, a strike, the primary bolt being mounted for sliding movement in said body between a latching position where, in use, the primary bolt engages in a latching configuration with the strike and a retracted position, and an operating element operatively coupled to the primary bolt to enable the primary bolt to be removed from the latching position to the retracted position, a retaining means to retain the primary bolt in the retracted position and a release member moveable with or independent of the primary bolt to effect release of the retaining means to release the primary bolt and enable it to move from the retracted position to the latching position, and an indicator means moveable in response to movement of the primary bolt to provide an indication visually apparent from an external surface of the body of the latch device being in a latching or non-latching configuration the indicator comprising an elongate member with a distal end for slidingly moving through an opening in the external surface of the body, wherein there is further provided two cover elements to cover the opening but moveable to enable said distal end to become visible.

15. The latch device as claimed in claim 14, wherein the cover elements comprise a pair of flaps carried by legs, the legs being moveable apart by movement of the elongate member to cause the flaps to move away from covering the opening.

16. The latch device as claimed in claim 14, wherein the distal end includes a knob.

17. A self-latching sash latch device including a latch body having a primary bolt, a strike, the primary bolt being mounted for sliding movement in said body between a latching position where, in use, the primary bolt engages in a latching configuration with the strike and a retracted position, and an operating element operatively coupled to the primary bolt to enable the primary bolt to be moved from the latching position to the retracted position, a retaining means to retain the primary bolt in the retracted position and a secondary bolt slidingly located in the primary bolt to be moveable together with the primary bolt and relative to the primary bolt, the secondary bolt has a leading end which has a first engagement surface which is exposed for contact with a part of the strike when the primary bolt is moved to the retracted position by the operating element, whereby contact between the first engagement surface and said part of the strike during relative movement between the body and strike causes the secondary bolt to move relative to the primary bolt to the position where the secondary bolt effects release of the retaining means to release the primary bolt and enable the primary bolt to move from the retracted position to the latching position.

* * * * *